US010907813B1

(12) United States Patent
Wang

(10) Patent No.: US 10,907,813 B1
(45) Date of Patent: Feb. 2, 2021

(54) ROTATABLE LAMPS IN A MOUNTING HEAD

(71) Applicant: Tiejun Wang, Lin'an (CN)

(72) Inventor: Tiejun Wang, Lin'an (CN)

( * ) Notice: Subject to any disclaimer, the term of this patent is extended or adjusted under 35 U.S.C. 154(b) by 0 days.

(21) Appl. No.: 16/553,299

(22) Filed: Aug. 28, 2019

(51) Int. Cl.
*F21V 21/30* (2006.01)
*F21V 21/35* (2006.01)
*F21Y 115/10* (2016.01)

(52) U.S. Cl.
CPC ..... *F21V 21/30* (2013.01); *F21V 21/35* (2013.01); *F21Y 2115/10* (2016.08)

(58) Field of Classification Search
CPC . F21V 21/30; F21V 21/35; F21S 8/026; F21S 8/02
See application file for complete search history.

(56) References Cited

U.S. PATENT DOCUMENTS

2017/0343190 A1* 11/2017 Georgiev ..... F21V 17/02
2017/0343195 A1* 11/2017 Cadisch ..... F21V 21/30
2020/0109850 A1* 4/2020 Gauthier ..... F21V 19/0055

* cited by examiner

*Primary Examiner* — Matthew J. Peerce
(74) *Attorney, Agent, or Firm* — Daniel M. Cohn; Howard M. Cohn

(57) ABSTRACT

A light fixture has at least one head lamp rotatably mounted to an installation board. One opening extends through the installation board into which the at least one head lamp is mounted. The at least one opening has a centerline x-x disposed perpendicular to a top surface of the installation board. One circular opening extends through an outside ring of the headlamp to mount an electrical connector having a hollow bore extending therethrough and adapted to provide a passageway for a wire to connect to a lighting assembly. The electrical connector is mounted so as to be able to pivot up to 360 degrees about a centerline through one circular opening and perpendicular to a surface of the outside ring adjacent to the circular opening irrespective of the rotational position of the headlamp on the installation board.

15 Claims, 6 Drawing Sheets

ROTATABLE LAMPS IN A MOUNTING HEAD

FIELD OF THE INVENTION

This generally relates to a lighting fixture which can contain one or more lamps based on white-light LEDs and more particularly lamps based on LED light that can rotate in their mounting head.

BACKGROUND

Lighting fixtures, particularly those with one or more LED spotlight heads have been used in the past. As the brightness of the LED light emitting element continues to increase, and has high emission efficiency, rich color, the characteristics of small volume, the LED light emitting element as a light source of the lighting fixture is gradually widely applied to various lighting fixtures. LED lights provide a new decorative lighting that appears more common in everyday use, and in some replace the traditional lamp lighting.

The conventional LED spotlights provide LED chips in a single single-head LED spotlight. Such single LED spotlight heads can only achieve the lighting of a small area close to the LED spotlight head. However, it is not able to achieve large area lighting and projection of a greater distance.

Currently single-head LED spotlights are fixed to a mounting plate, or on a sliding rail disposed on a conductive track. Since the high-power multi-chip LED lighting design creates a heat problem, it cannot effectively radiate heat that would severely affect the practical life of the lamp.

A conventional LED spotlight steering pivot structure cannot effectively guarantee the life of the lamp after multiple rotational direction and rotational positioning, adjustments and thus fill the need for multiple regions of light within the illumination space.

SUMMARY OF THE INVENTION

In accordance with the present invention, a light fixture has at least one head lamp rotatably mounted to an installation board. At least one opening extends through the installation board into which the at least one head lamp is mounted. The at least one opening has a centerline x-x disposed perpendicular to a top surface of the installation board. The at least one head lamp is mounted to the installation board so that the at least one head lamp can rotate 360 degrees about the centerline x-x disposed perpendicular through the at least one opening through the installation board. At least one circular opening extends through an outside ring of the at least one headlamp to mount an electrical connector having a hollow bore extending therethrough and adapted to provide a passageway for a wire to connect to a lighting assembly. The electrical connector is mounted so as to be able to pivot up to 360 degrees about a centerline z-z through the at least one circular opening and perpendicular to a surface of the outside ring adjacent to the at least one circular opening irrespective of the rotational position of the at least one headlamp on the installation board.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1:
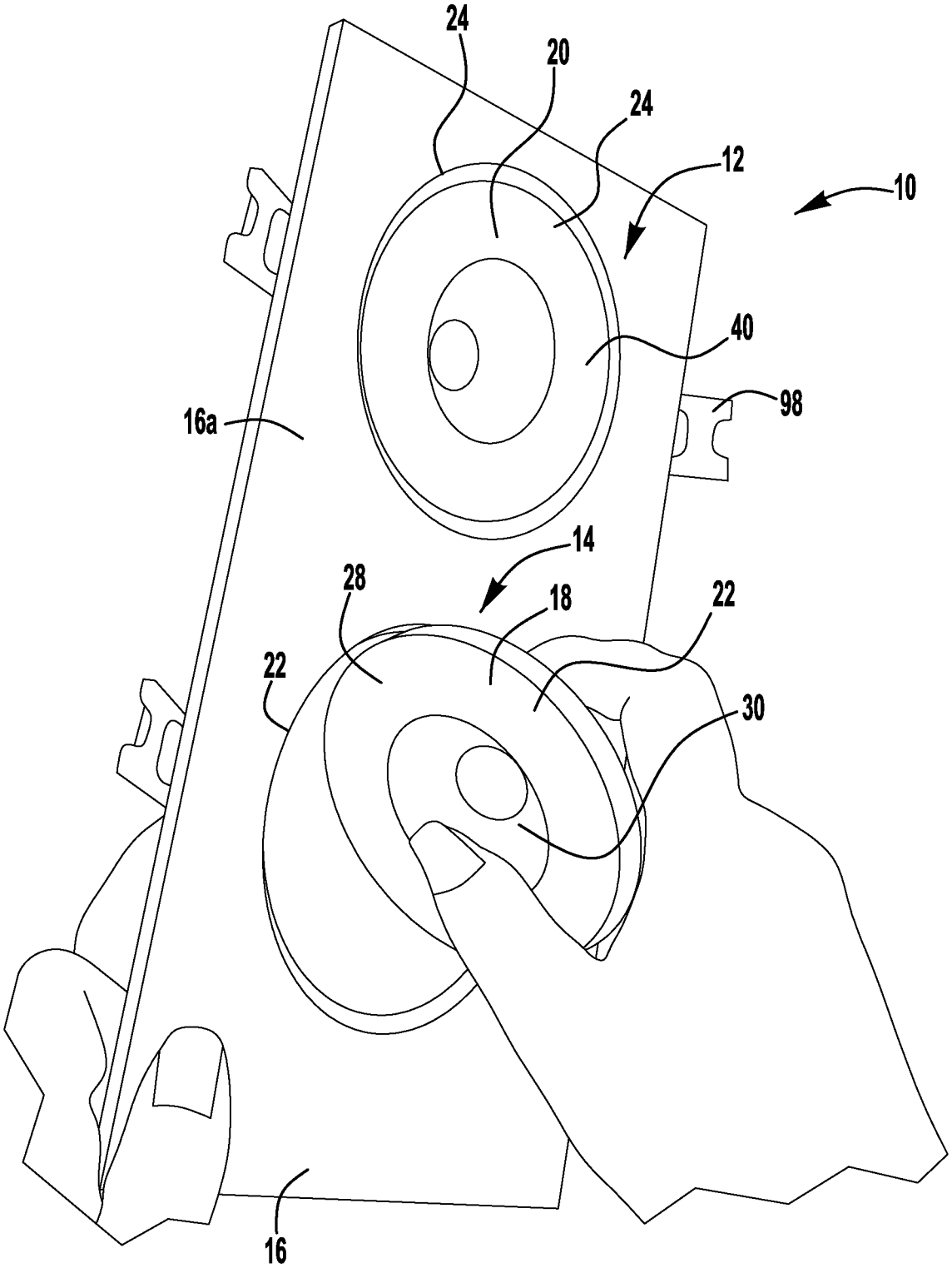

Often, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

FIG. 1 is a top three-dimensional view of a lighting fixture with two heads mounted to an installation board, according to the present invention.

Figure 2:
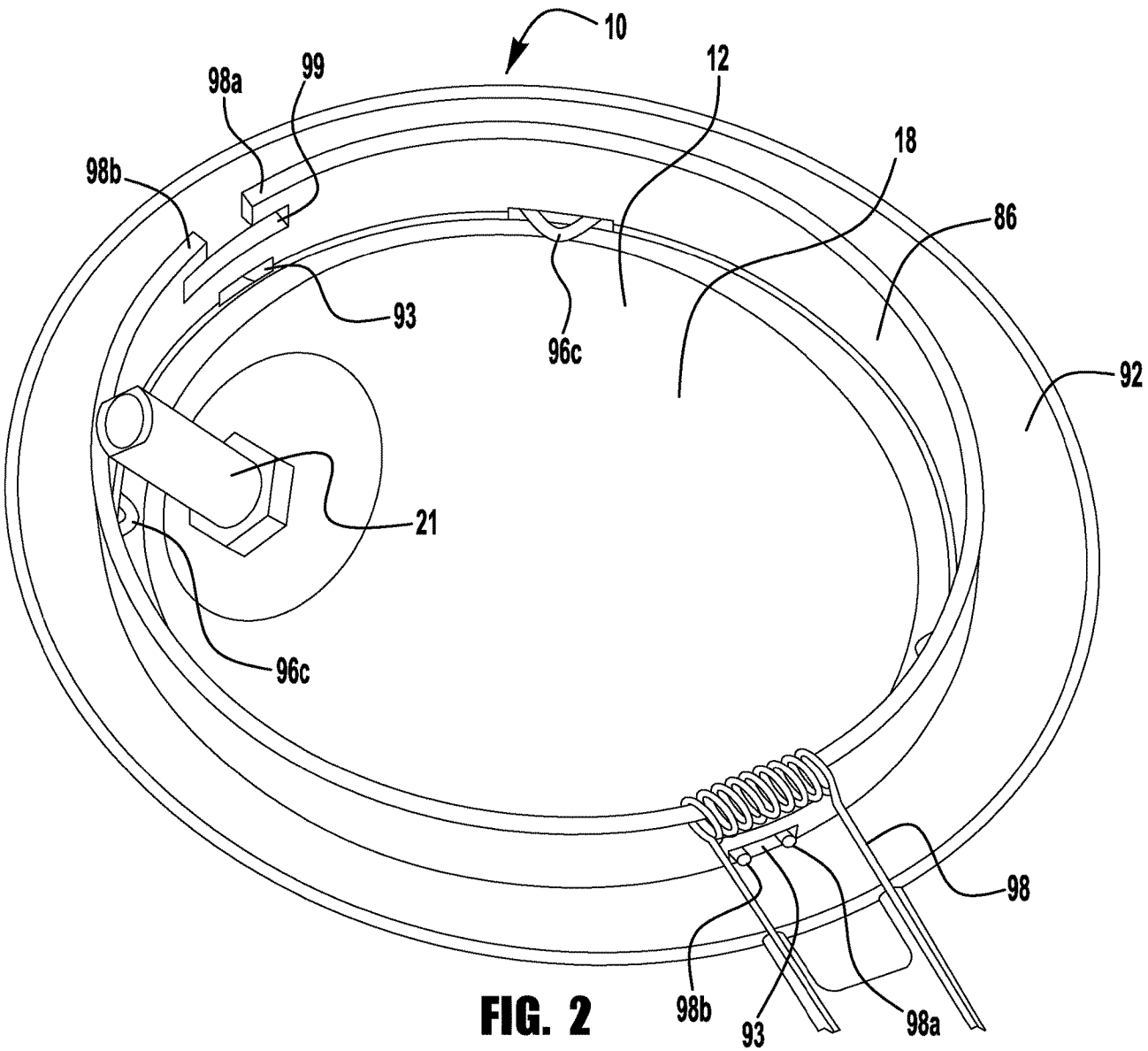

FIG. 2 is a bottom three-dimensional view of a head of a lighting fixture mounted to an installation board, according to the present invention.

Figure 3:
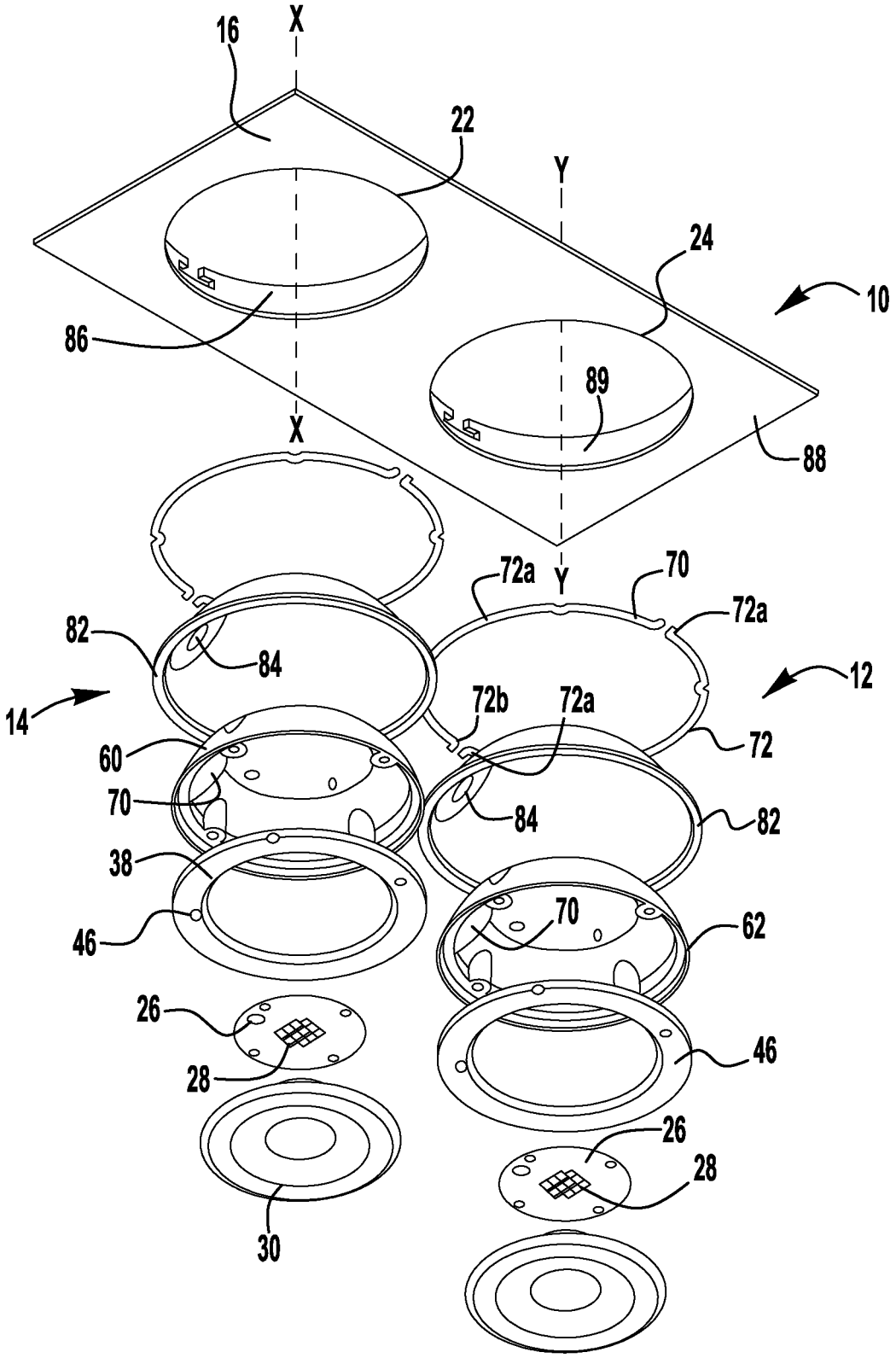

FIG. 3 is an exploded, three-dimensional view of two heads of the lighting fixture shown on FIG. 2 mounted onto the mounting surface of an installation board, according to the present invention.

Figure 4:
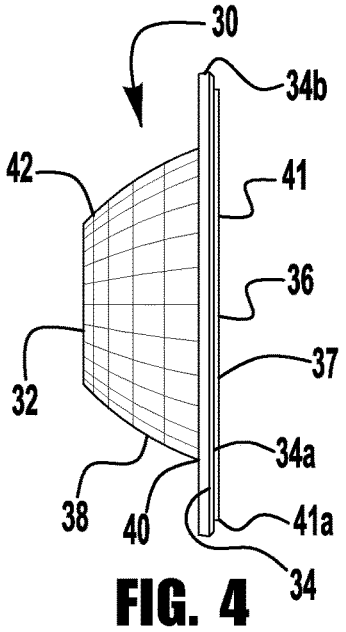

FIG. 4 is a side, cross-sectional view of a lens, according to the present invention.

Figure 5:
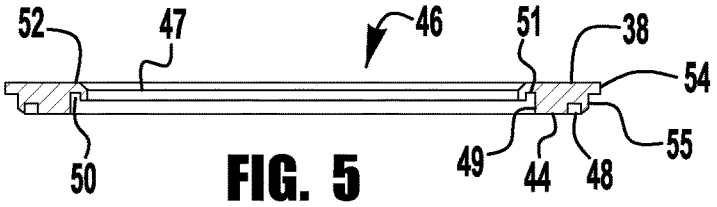

FIG. 5 is a side, cross-sectional view of the lens installation ring, according to the present invention.

Figure 6A:
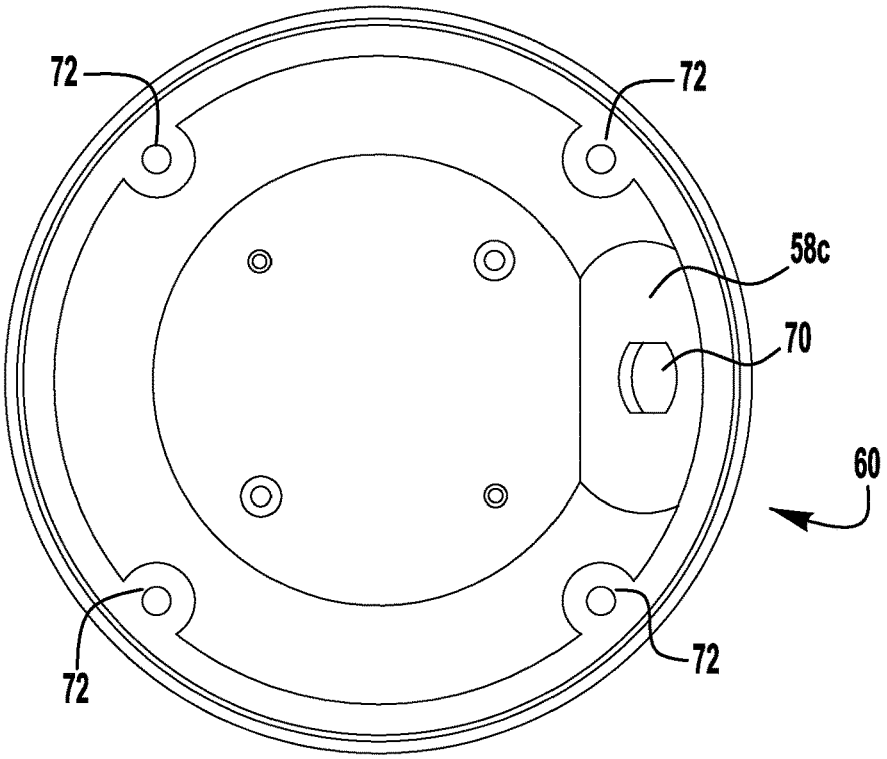

FIG. 6A is a top view of a heat sink, according to the present invention.

Figure 6B:
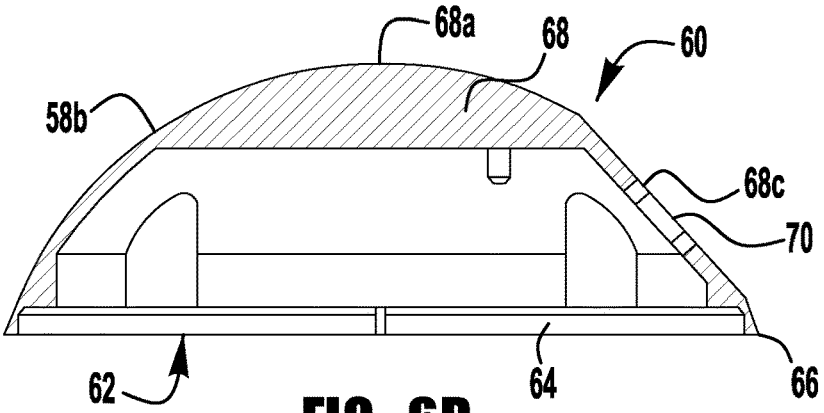

FIG. 6B is a side, cross-sectional view of a heat sink, according to the present invention.

Figure 7:
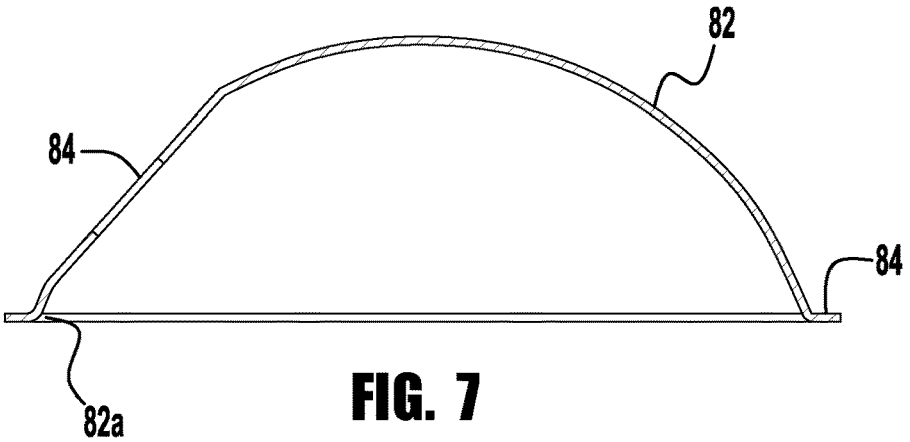

FIG. 7 is a side, cross-sectional view of an outside ring, according to the present invention.

Figure 8:
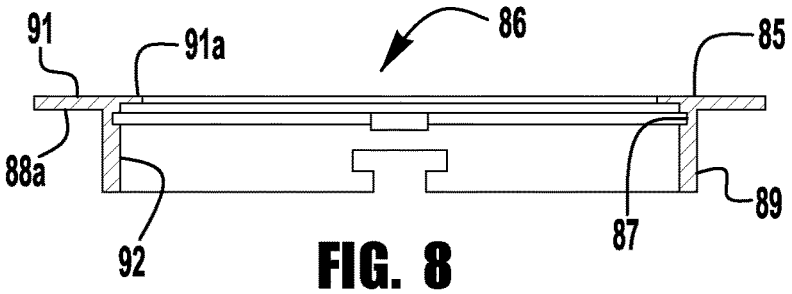

FIG. 8 is a side, cross-sectional view of the mounting surface installation ring shown mounted to the underside of the installation board, according to the present invention.

Figure 9:
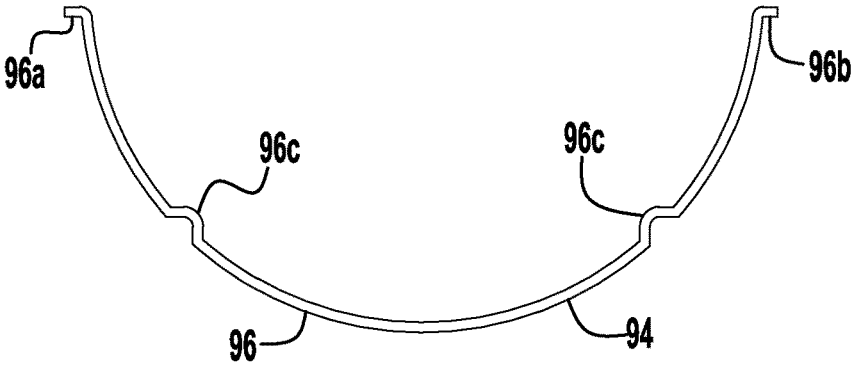

FIG. 9 is a side view of a mounting spring, according to the present invention.

Figure 10:
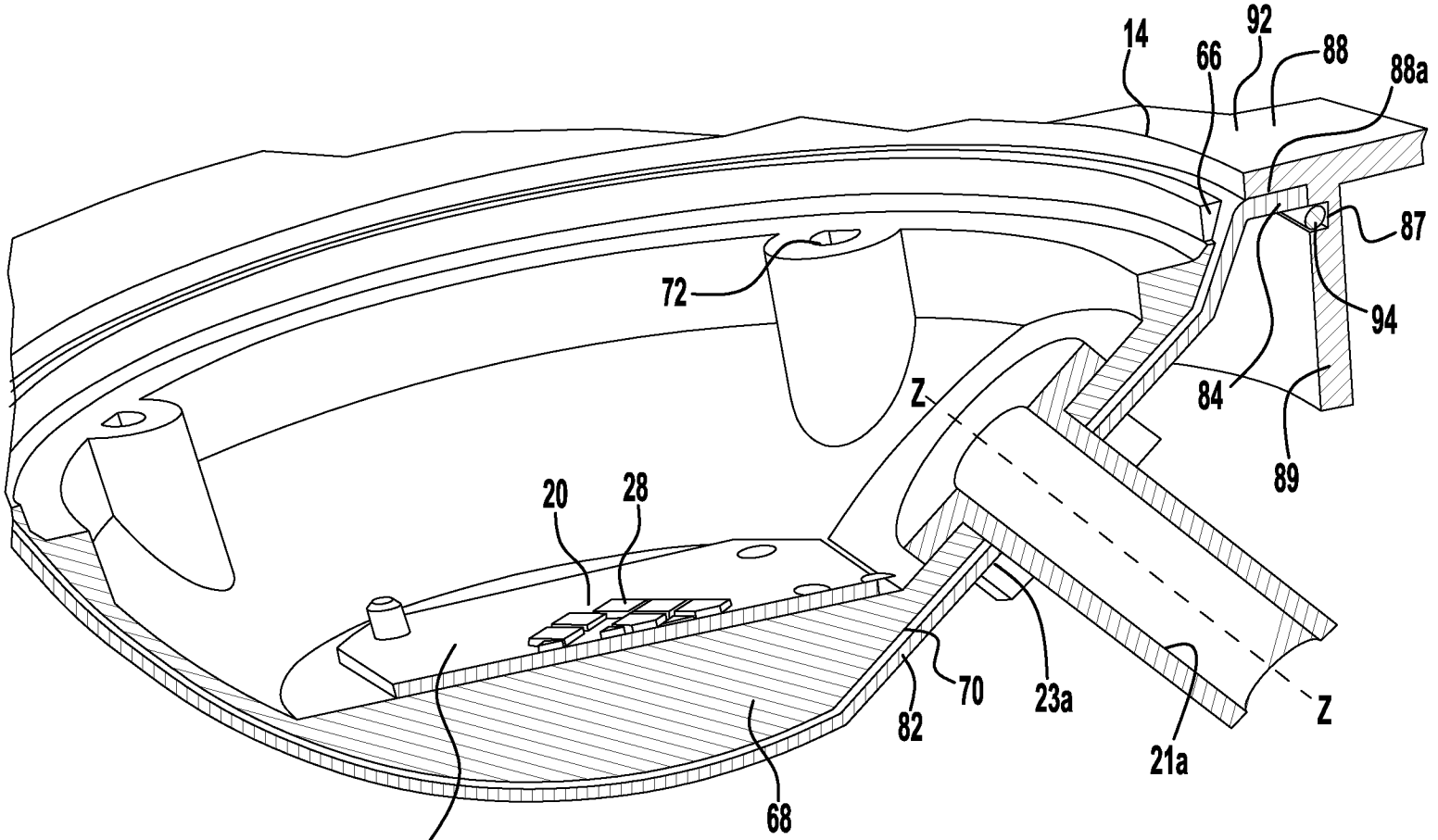

FIG. 10 is a three dimensional, cross-sectional view of the a head of a lighting fixture mounted to an installation board, according to the present invention.

DETAILED DESCRIPTION OF THE PREFERRED EMBODIMENTS

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

Referring to FIG. 1, there is illustrated a top, three-dimensional view of a lighting fixture 10 with one or more head lamps 12 and 14 mounted to an installation board 16. FIG. 2 illustrates a bottom, three-dimensional view of one of the head lamps 12 of the lighting fixture 10 shown in FIG. 1. While the lighting fixture 10 is shown with two lamps 12 and 14, it is within the terms of the present invention to provide any number of lamps such as, for example only, a single head lamp, three lamps and/or 4 lamps.

An important aspect of the present invention is that the head lamps, i.e., 12 and 14, are typically lighting, such as LED assemblies 18 and/or 20. The LED assemblies 18 and/or 20. are mounted to openings 22 and 24 through the installation board 16 so as to be able to rotate 360 degrees about a centerline x-x disposed perpendicular through openings 22 and 24 with respect to the top surface 16*a* of the installation board 16.

In addition, the LED assembly 18 and 20 of the head lamps, i.e., 12 and 14, respectively, are mounted so that an electrical connector 21 having a hollow bore 21*a* extending therethrough can be connected by a wire to the LED assemblies. The electrical connector 21 provide a passageway for a wire from an electric plug (not shown) mounted to the electrical connector 21 to be connected to LED assemblies 18/20. The electrical connector 21 is mounted to an opening through an opening 23 in the outside ring 82. The electrical connector 21 is mounted so as to be able to pivot up to 360 degrees about a centerline z-z through the opening 23 and perpendicular to the surface 23*a* of the outside ring 82 adjacent to the opening 23 irrespective of the rotational position of the headlamps on the installation board 16.

In order to rotate or pivot the LED assemblies 18 and 20, a mechanical force is applied, such as by hand as shown in FIG. 1, to the lens retaining rings 38 and 40 of the LED assemblies 18 and 20, respectively. When the rotational movement of the LED assemblies 18 and 20 is desired, the lens retaining rings 38 and 40 of the LED assemblies 18 and 20, respectively are rotated 360 degrees about a centerline x-x, while remaining aligned in an axial direction relative to the installation openings 22 and 24.

When the pivotable movement of the LED assemblies 18 and 20 is desired, the lens retaining rings 38 and 40 of the LED assemblies 18 and 20, respectively are pressed downward on one side, as shown in FIG. 1, so that a portion of one of the lens retaining rings 38 and 40 projects above the top surface 16*a* of the installation board 16. It's noteworthy that the lens retaining rings 38 and 40 of the LED assemblies 18 and 20 can be pressed downward irrespective of the rotational location of the lens retaining rings 38 and 40 with respect to the top surface 16*a* of the installation board 16.

An aspect of the present invention, is that the rotational and pivotable positioning of both of the LED assemblies 18 and 20 allows for more control of the illumination of the space being ht by the lighting fixture 10.

Referring to FIG. 3, there is shown an exploded view of the lighting fixture 10. In this embodiment, two head lamps 12 and 14, are shown below openings 22 and 24 through the installation board 16. Each of the head lamps 12 and 14 includes a printed circuit board (PCB) 26 that has a light-emitting diode (LED) 28, i.e., a semiconductor light source that emits light when current flows through it, mounted thereto.

The PCB 26 is disposed behind a lens 30, as shown in FIG. 4, having a flat, rear surface 32 and a circular, disk-shaped plate 34 with an opening 36 in the middle thereof forming the front surface 37. A curved side wall 38 extends between the inner circular edge 40 of the disk-shaped plate 34 and the outer circular edge 42 of the flat rear surface 32 for concentrating and/or dispersing light rays emitted from the LED 28. The flat rear surface 32 can have a prismatic shaped surface for concentrating and/or dispersing light rays emitted from the LED 28. The circular, disk-shaped plate 34 has a circular ring 41 extending from the surface 34*a* of the disk-shaped plate 34 so as to form a circular lip 34*b* projecting past the outer edge 41*a* of the circular ring 41.

As shown in FIG. 3, the lens 30 is mounted to a cylindrical, lens retaining ring 46 having an outer facing surface 38, an inner facing surface 44 and a hollow center through section 47, best seen in FIG. 5. The lens retaining ring 46 has a circular outer groove 48 formed on the inner facing surface 44 and a circular inner groove 50 formed in a shoulder 51 having an upper surface 52 that extends inward from the outer facing surface 38. The inner surface of the groove 51 forms the inner wall facing surface 49 of the open center through section 47. Lens retaining ring 46 has an outer circular surface 38 with a circular lip 54 which extends past the outer facing circular surface 55 of the retaining ring 46. The outer circumference of the plate 34 of lens 30 is received in the circular inner groove 51 when the lens 30 and the lens retaining ring 46 are mounted to each other, as indicated in FIG. 3.

Next the lens retaining ring 46 in combination with the lens 30 is mounted to the heat dissipation body 60. The heat dissipation body 60, as seen in FIG. 6B, has an inner, circular side 62 having a recessed surface 64 with a circular outer end projection 66 thereabout. As seen in FIG. 6A, the heat sink 60 has a bottom, inner end 68 which has a curved outer surface 68*a* which extends along the majority of the bottom, inner end surface 68. A section 68*c* of the bottom surface has a flat surface with an aperture 70 therethrough. The aperture 70 allows for an electric wire (not shown) to be secured to the PCB board 26. As shown in FIG. 6A, a plurality of threaded holes 72 are provided around periphery of the heat dissipation body 60.

Referring to FIG. 7, there is illustrated an outside ring 82 which is shaped to receive the heat dissipation body 60. As shown in FIG. 7, the outside ring 82 that includes an opening 84 which aligns with the opening 70 in the outside ring shown in FIG. 6A. A circular lip 84 extends around and outward from the outer end 82*a* of the outside ring 82.

The combination of components including the lens 30, the PCB board 26, the lens retaining ring 46, and the heat dissipation body ring 60 are secured to each other and then inserted into a mounting surface ring 86, as shown in FIG. 8, secured to the inner surface 88*a* of an installation board 88. The mounting surface ring 86 has a circular slot 87 formed in an upstanding circular wall 89. A circular overhang 91 has an inner surface 91*a* that projects into an open bore 92 that projects through the mounting surface ring 86. The mounting ring 86 has a slot 93 formed through the circular wall 89 to receive the inner ends 98*a* and 98*b* of a coil spring 98 so as to secure the spring to the mounting ring 86. A slot 99 is formed through the wall 89 and includes shoulders 99*a* and 99*b* which are inserted into opposite ends of the coil of the coil spring 98. The coil spring 98 puts a bias force on the mounting ring 86 with respect to the installation board 16.

As seen in FIG. 3, the outside ring 82, which supports the components is secured to the inner surface 68*a* of an installation board 68, between the upstanding wall 89 and inner surface 88*a*. The outside ring 82 is secured in place by torsion springs 94, as shown in FIG. 10. The torsion spring 94 has two, semi-circular curved shape sections 76 are each formed with outer ends 96*a* and 96*b* projecting outward to form a lip at either end.

After the combination of components are disposed in the mounting surface ring 86, and secured therein with the torsion springs 94, as shown in FIG. 2, the head lamps, i.e., 12 and 14, disposed so that outer facing circular surface 55 of the retaining ring 46 is flush with the top surface 16*a* of the installation board 16.

A coil spring 98 is mounted into the slot By pressing on the lens retaining rings 38 and 40 with respect to the top surface 16*a* of the installation board 16, the head lamps, i.e., 12 and 14, able to pivot in any direction up to 90 degrees irrespective of the rotational position of the headlamps on the installation board. As shown in FIG. 1, the head lamp 12 is pivoted so that a section of the retaining ring is disposed above the top surface 16*a*. It is also within the terms of the present invention to rotate the head lamps with respect to the top surface 16*a* of the installation board 16.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A light fixture having at least one head lamp rotatably mounted to an installation board, comprising:

at least one opening through the installation board into which the at least one head lamp is mounted;

the at least one opening having a centerline x-x disposed perpendicular to an upper surface of the installation board;

the at least one head lamp being mounted to the installation board so that the at least one head lamp can rotate 360 degrees about the centerline x-x disposed perpendicular through the at least one opening through the installation board;

each of the at least one headlamp comprising:

a mounting surface ring having an upstanding wall secured to an inner surface of the installation board and disposed about the at least one opening through the installation board;

an outside ring which supports the at least one head lamp being mounted about the at least one opening and against the inner surface of the installation board, and the outside ring being secured within the upstanding wall of the mounting surface ring;

a lens retaining ring having a lens mounted thereto, the lens retaining ring being secured to the outside ring whereby an outer facing surface of the lens retaining ring can be rotated 360 degrees about the centerline x-x while remaining aligned in an axial direction relative to the at least one opening through the installation board and whereby as the lens retaining ring is pressed downward on one side with respect to the upper surface of the installation board so that a portion of the lens retaining ring pivots below the upper surface of the installation board an opposing portion of the lens retaining lens projects above the upper surface of the installation board;

an outside ring opening extending through a wall of the outside ring of the at least one headlamp; and an electrical connector having a hollow bore extending through the outside ring opening and being mounted to the outside ring opening and adapted to provide a passageway through the hollow bore for a wire to connect to the at least one head lamp supported in the outside ring.

2. The light fixture of claim 1 further comprising the electrical connector being mounted through the outside ring opening whereby the hollow bore providing the passageway for the wire is able to pivot up to 360 degrees about a centerline z-z through the outside ring opening and perpendicular to a surface of the outside ring adjacent to the outside ring opening irrespective of the rotational position of the at least one headlamp on the installation board.

3. The light fixture of claim 2 further comprising a plurality of head lamps rotatably mounted to the installation board.

4. The light fixture of claim 2 wherein the lens retaining ring of each of the plurality of head lamps can be pressed downward on one side irrespective of the rotational location of the lens retaining ring with respect to the upper surface of the installation board.

5. The light fixture of claim 2 wherein each of the plurality of head lamps includes a printed circuit board that has a light-emitting diode that emits light when current flows through it.

6. The light fixture of claim 5 wherein the printed circuit board of each of the plurality of head lamps is disposed behind the lens, the lens comprising a rear surface having a flat shape and a front surface having a disk-shape and an opening through the middle thereof.

7. The light fixture of claim 6 wherein the lens has a curved side wall that extends between an inner circular edge of the front surface and an outer circular edge of the flat rear surface for dispersing light rays emitted from the light-emitting diode behind the lens.

8. The light fixture of claim 7 wherein the flat rear surface has a prismatic shaped surface for dispersing light rays emitted from the light-emitting diode behind the lens.

9. The light fixture of claim 8 wherein the lens is mounted to a cylindrical, lens retaining ring having an outer facing surface, an inner facing surface and a hollow center through the lens retaining ring.

10. The light fixture of claim 1 wherein the lens retaining ring in combination with the lens is mounted to a heat dissipation body having a heat sink disposed at a bottom inner end and the heat dissipation body shaped to be received in the outside ring and the heat dissipation body having an opening therethrough which aligns with the outside ring opening through the outside ring whereby the electrical connector can pivot up to 360 degrees about a centerline z-z through the outside ring opening.

11. The light fixture of claim 10 wherein the mounting surface ring has a circular slot formed in the upstanding circular wall to receive inner ends of a coil spring so as to secure the coil spring to the mounting surface ring.

12. A light fixture having at least one head lamp rotatably mounted to an installation board, comprising:

at least one opening through the installation board into which the at least one head lamp is mounted;

the at least one opening having a centerline x-x disposed perpendicular to an upper surface of the installation board;

the at least one head lamp being mounted in the at least one opening of the installation board so that the at least one head lamp can rotate 360 degrees about the centerline x-x disposed perpendicular through the at least one opening through the installation board;

each of the at least one headlamp comprising:

a mounting surface ring having an upstanding wall secured to an inner surface of the installation board and about the at least one opening through the installation board;

an outside ring which supports the at least one head lamp being mounted about the at least one opening and against the inner surface of the installation board, and the outside ring being secured within the upstanding wall of the mounting surface ring:

a lens retaining ring having a lens mounted thereto, the lens retaining ring being secured to the outside ring whereby an outer facing surface of the lens retaining ring can be rotated 360 degrees about the centerline x-x while remaining aligned in an axial direction relative to the at least one opening through the installation board and whereby as the lens retaining ring is pressed downward on one side with respect to the upper surface of the installation board so that a portion of the lens retaining ring pivots below the upper surface of the installation board an opposing portion of the lens retaining lens projects above the upper surface of the installation board;

the at least one head lamp being mounted in the at least one opening of the installation board so that the at least one head lamp can rotate 360 degrees about the centerline x-x disposed perpendicular through the at least one opening through the installation board;

an outside ring opening extending through a wall of the outside ring of the at least one headlamp;

an electrical connector having a hollow bore extending through the outside ring opening and being mounted to the outside ring opening and adapted to provide a passageway through the hollow bore for a wire to connect to the at least one head lamp supported in the outside ring; and the electrical connector being mounted through the outside ring opening whereby the hollow bore providing the passageway for the wire is able to pivot up to 360 degrees about a centerline z-z through the outside ring opening and perpendicular to a surface of the outside ring adjacent to the outside ring opening irrespective of the rotational position of the at least one headlamp on the installation board.

13. The light fixture of claim 12 wherein the lens retaining ring of each of the at least one head lamp can be rotated 360 degrees about the centerline x-x, while remaining aligned in an axial direction relative to the at least one opening through the installation board.

14. The light fixture of claim 13 wherein each of a plurality of head lamps has a printed circuit board are disposed behind a lens comprising a rear surface having a flat shape and a front surface having a disk-shape and with an opening through a middle of the front surface for dispersing light rays emitted from a light-emitting diode behind the lens.

15. The light fixture of claim 14 wherein the lens retaining ring in combination with the lens is mounted to a heat dissipation body having a heat sink disposed at a bottom inner end and the heat dissipation body shaped to be received in the outside ring and the heat dissipation body having an opening therethrough which aligns with an opening through the outside ring whereby the electrical connector can pivot up to 360 degrees about a centerline z-z through the outside ring opening.

* * * * *